United States Patent [19]

Thuerman

[11] Patent Number: 4,893,464

[45] Date of Patent: Jan. 16, 1990

[54] OFFSET ATTACHMENT SIDEBAR CHAIN

[75] Inventor: John H. Thuerman, West Allis, Wis.

[73] Assignee: Rexnord Corporation, Milwaukee, Wis.

[21] Appl. No.: 279,528

[22] Filed: Dec. 2, 1988

[51] Int. Cl.[4] ..... F16G 13/06

[52] U.S. Cl. ..... 59/78; 59/5; 37/86; 37/191 A; 37/192 A; 83/831; 299/82; 299/84; 198/851

[58] Field of Search ..... 37/141 R, 142 R, 141 T, 37/83, 86, 191 A, 192 R, 192 A; 83/830, 831, 832; 59/78, 4, 5, 93; 30/383, 386, 387; 299/82, 83, 84; 198/850, 851, 853

[56] References Cited

U.S. PATENT DOCUMENTS

| | | | |
|---|---|---|---|
| 1,281,934 | 10/1918 | Fraser | 198/851 |
| 1,953,388 | 4/1934 | Bettin | 198/851 |
| 3,153,867 | 10/1964 | Golden | 37/191 A |
| 3,754,341 | 8/1973 | Caldwell et al. | 37/191 A |
| 3,913,979 | 10/1975 | Strauss et al. | 37/191 A |
| 3,932,951 | 1/1976 | Scott et al. | 37/86 |
| 4,404,761 | 9/1983 | Paulin et al. | 37/191 A |
| 4,464,151 | 8/1984 | Kahl | 474/231 |
| 4,571,859 | 2/1986 | Leischer | 37/191 A |
| 4,833,797 | 5/1989 | Slunecka et al. | 37/86 |

OTHER PUBLICATIONS

Chain Belt Company, Catalog No. 520, Jan. 1950.
Chain Belt Company, Bulletin No. 54—54, 1955.
American Chain Association, Design and Applications Handbook, 1982.
Caterpillar Industrial Products, Inc., Track Chain Literature, 1983.
Trencher Jetco, Models 830L and 1400L Chain Trenchers, Sep. 1985.
Illustration of a Trenching Machine and a Controversial Straight Sidebar Type of Chain.

*Primary Examiner*—David Jones
*Attorney, Agent, or Firm*—Michael, Best & Friedrich

[57] ABSTRACT

An offset sidebar chain for use in a machine including pairs of offset sidebars having heights perpendicular to the direction of chain travel, when the chain is in use, at least one pair of offset sidebars of the chain having an extended height, and each including a first portion having opposite ends, a forward end adapted to be connected by a chain pin to a preceding pair of sidebars, and a rearward end adapted to be connected by another chain pin to a trailing pair of sidebars and the pair of extended height sidebars including an extended height portion having structure for supporting a tool.

21 Claims, 2 Drawing Sheets

OFFSET ATTACHMENT SIDEBAR CHAIN

FIELD OF THE INVENTION

This invention relates to chains, and offset sidebar chains for use on machines such as trenching, conveying or scraping machines, in particular.

BACKGROUND PRIOR ART

Trenching machines in current use commonly employ straight sidebar types of chains for trenching. A disadvantage associated with the straight sidebar chains is that the chain links do not wear the same way at each link, but rather wear differently at inside links than outside links. This results in differences in the pitch of alternate links of the chain and thereby causes increased wear of the sprocket teeth which engage the chain.

In many applications, offset sidebar chains are preferable to straight sidebar chains because chains of offset link construction exhibit uniform wear at each chain link, and internal chain joint wear causes chain pitch to increase by the same amount in each chain link. This permits more uniform wear of the sprocket teeth, resulting in optimum service life of the equipment making use of the chain. Additionally, use of offset sidebar chains when run open end forward also results in reduced sprocket teeth and chain roller wear during articulation over a drive sprocket.

While the advantages of offset sidebar chains in many applications are well known, offset sidebar chains have not been developed which are capable of supporting tools, for use in many machines such as trenching, conveying or scraping machines. Accordingly, an object of the invention is to provide an offset sidebar chain for use in machines such as trenching, conveying or scraping machines, wherein tool supporting structure extends from the sidebars of the chain.

SUMMARY OF THE INVENTION

The invention provides an offset sidebar chain constructed in such a fashion that tools may be attached, for use in a machine such as a trenching, conveying, or scraping machine, the chain providing improved wear resistance and having a longer wear life than prior art chains used in trenching machines and conveyors such as asphalt conveyors. More specifically, the chain embodying the invention includes at least one pair of offset sidebars of extended height. The sidebars of the chain each include a first portion having opposite ends, a forward end adapted to be connected by a chain pin to a preceding pair of sidebars and a rearward end adapted to be connected by another chain pin to a trailing pair of sidebars. The extended height sidebars include an extended height portion having structure for supporting a tool such as a cutter, or pusher or scraper plate.

In another aspect of the invention, alternate pairs of offset sidebars of the chain have extended heights.

In a further aspect of the invention, the extended length sidebars each include a continuous offset bend extending through their first portions and continuing through their extended height portions so that the forward end of each sidebar is parallel to and offset from its rearward end.

In another aspect of the invention, the extended height sidebars of the chain are formed by cold stamping steel plates.

In one aspect of the invention, the tool attached to the extended height sidebars of the chain is a cutter having a leading portion and a trailing portion, the leading portion including a cutting edge wherein the leading portion of the cutter is fastened to both sidebars of the pair of extended height sidebars, and the trailing portion of the cutter is fastened to one sidebar of the pair of extended height sidebars. In a preferred embodiment, a spacer is included between the rearward end of the extended height portion of the extended height sidebar and the trailing portion of the cutter.

In a preferred embodiment of the invention, the offset sidebar chain includes a bore through the rearward end of each sidebar of the pair of extended height sidebars for receiving a bushing. The bushing surrounds a portion of at least one of the chain pins. One end of the bushing is housed in the rearward end of one of the sidebars, and the other end of the bushing is housed in the bore in the rearward end of the other of the sidebars. A roller surrounds a portion of the bushing.

These and other features, objects, and advantages of the invention will become apparent to those of ordinary skill in the art from the following description of the preferred embodiments of the invention, which is given by way of example, reference being made to the accompanying drawings.

DETAILED DESCRIPTION OF THE PREFERRED EMBODIMENTS OF THE INVENTION

A description of the preferred embodiments of the invention will now be provided, reference being made to the various drawings.

Figure 3:
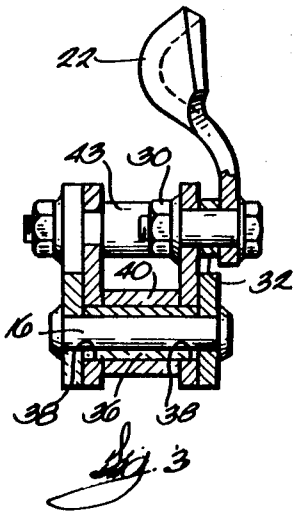
FIG. 3 is a view of a vertical section taken along line 3—3 of FIG. 2.
Figure 2:
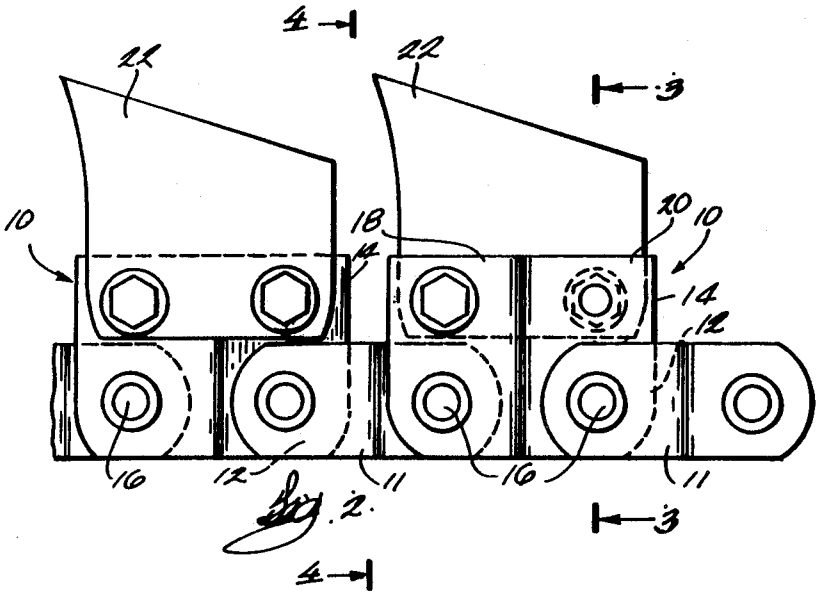
FIG. 2 is a front view of the chain of FIG. 1.
Figure 1:
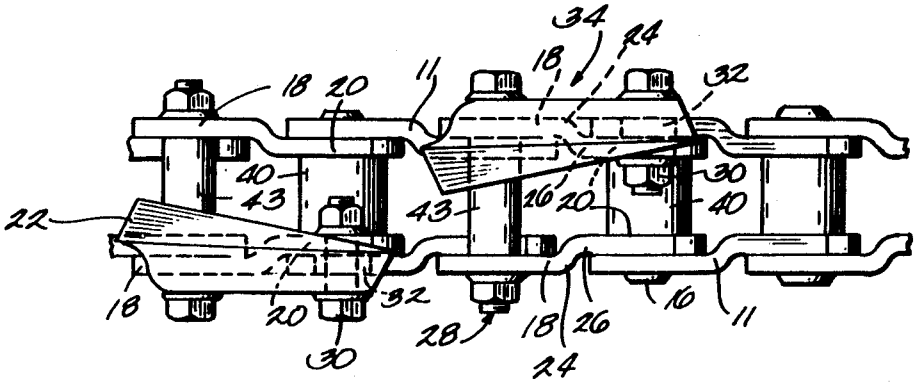
FIG. 1 is a top view of a broken away portion of a chain embodying the invention for use on a trenching machine.
Figure 4:
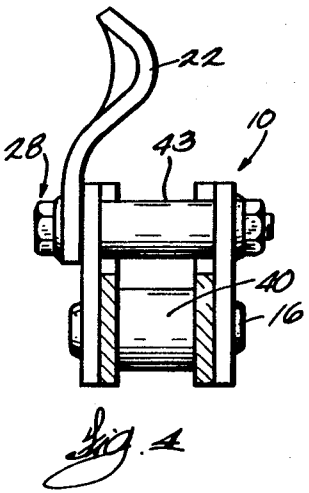
FIG. 4 is a view of a vertical section taken along line 4—4 in FIG. 2.

FIGS. 1–4 show a portion of an offset sidebar chain embodying the invention and adapted for use in a trenching machine. The chain shown in FIG. 1 is designed to travel from right to left, i.e., open end forward. Pairs of offset sidebars 10 and 11 are shown including pairs of extended height sidebars 10 (see FIG. 2) joined by connecting offset sidebars 11. The extended height sidebars 10 each have a first portion 12 and an extended height or upper tool supporting portion 14. Each pair of sidebars 10 has a forward end 18 (see FIG. 1), which is connected to a preceding pair of sidebars 11 by a chain pin 16 (see FIG. 2), and a rearward end 20 (see FIG. 1) which is connected to a trailing pair of sidebars 11 by a chain pin 16 (See FIG. 3). The extended height portion 14 of each pair of extended height sidebars 10 supports a tool. While other tools could be attached to extended height portion 14, FIGS. 2–4 show cutters 22 attached to the extended height portions 14 of the extended height sidebars.

In the offset sidebar chain of the illustrated embodiment, alternate pairs of offset sidebars of the chain are extended height sidebars 10. While other configurations are possible, FIG. 1 shows cutter attachment 22 fastened to alternate sides of the chain at each alternate pair of extended height sidebars of the chain. It is envisioned that extended height sidebars could be provided on every second, third, or fourth link of the chain, for example, or that other spacing arrangements could be used. Similarly, attachments or tools, such as cutters 22, could be provided on every second, third, or fourth pair of extended height sidebars for example, or other spacing arrangements could be used —in other words, not every pair of extended height sidebars need support a tool.

Referring to FIG. 1, it can be seen that each extended height sidebar 10 includes an offset bend defined by two continuous bend lines 24 and 26 extending through their lower portions and continuing through their extended height portions so that the forward end of each sidebar of the chain, including the extended height sidebars, is parallel to and offset from its rearward end. The bend lines 24 and 26, as shown in FIG. 1, are relatively sharp bends. The extended height sidebars including bends 24 and 26 are formed by cold stamping steel plates, as opposed to hot forging metal, for reduced cost of production.

As most clearly shown in FIGS. 1, 3, and 4, when the tool to be attached to the extended height sidebars 10 is a cutter 22, it is fastened by a fastening means such as bolts 28 to both sidebars of the pair of extended height sidebars 10 at the forward end 18 of the pair with a bushing or spacer 43 interposed and surrounding bolt 28 to maintain a proper distance between the sidebars, and is fastened to one sidebar of the pair of extended height sidebars 10 at the rearward end 20 of the Pair by a second fastening means 30, with a spacer 32 (see FIG. 3) interposed. The spacer 32 is provided to compensate for the distance that the forward end 18 is offset from the rearward end 20 of the extended height sidebar 10. The cutter 22 is fastened to both sidebars 10 at the forward end 18 in order to distribute and equalize the forces transmitted from the cutter 22, when the chain is used on a trenching machine, to both sidebars of the pair of extended height sidebars 10, while at the rearward end 20, cost and weight is saved by fastening to a single sidebar. It is believed that the configuration provided allows integration of the cutter 22 into the chain link for more efficient trenching operation, as opposed to the trenching action of adjacent links of straight sidebar type chains. Further, the offset chain attachment design also provides for more aggressive digging by the cutters 22, because the amount that the pair of fixed ended height sidebars 10 supporting a cutter 22 can flex backwards, when the cutters hit the ground during trenching, is limited as the rearward end 20 of each sidebar of the extended height sidebar pair hits the offset portion of each sidebar of the trailing pair of sidebars 11, which offset portion is defined by the bend lines 24 and 26.

Referring to FIG. 3, the components used to join pairs of sidebars together can be seen in detail. A portion of the chain pin 16 is surrounded by a bushing 36. The bushing 36 extends from within a bore 38 in a rearward end 20 of one sidebar of one pair of sidebars to within a bore 38 in the rearward end of the other sidebar of the same pair of sidebars to keep a proper distance between the sidebars. A roller 40 surrounds a portion of bushing 36 between the rearward ends of the pair of sidebars. Since the chain construction disclosed herein minimizes wear at the chain pin 16, the roller 40 can be omitted, in certain applications, for reduced chain cost. The chain pin 16 attaches the rearward ends of the pair of sidebars to the forward end of the next pair of sidebars in the chain.

Figure 5:
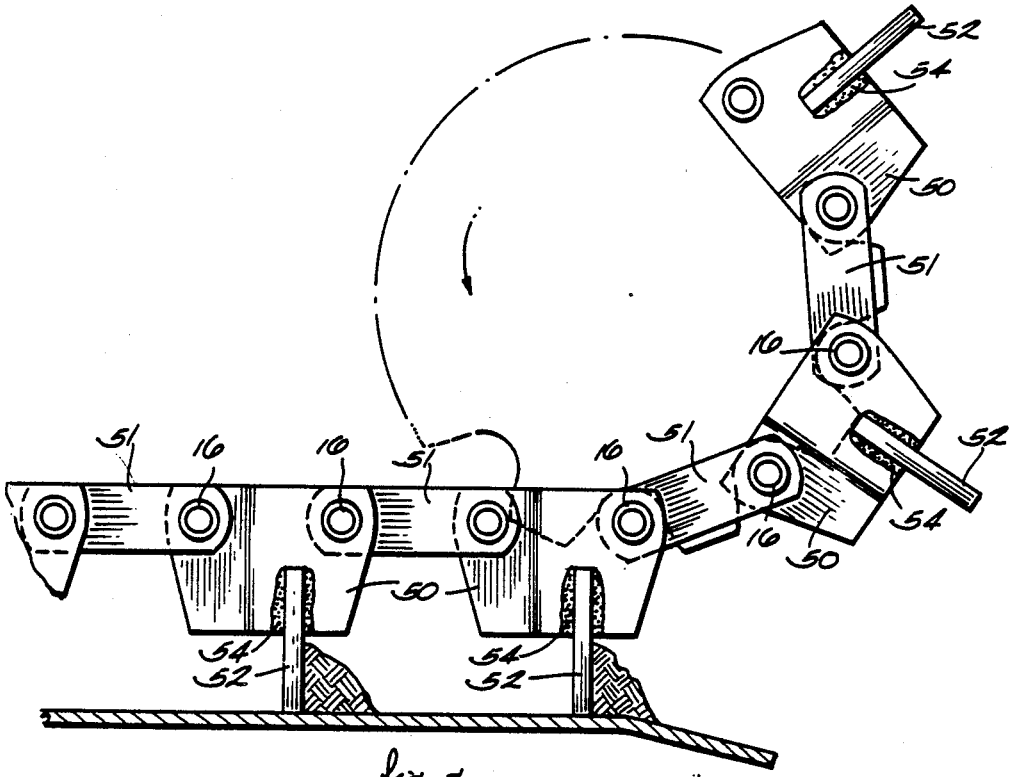
FIG. 5 is a front view of a portion of chain embodying the invention being used in a conveyor.
Figure 6:
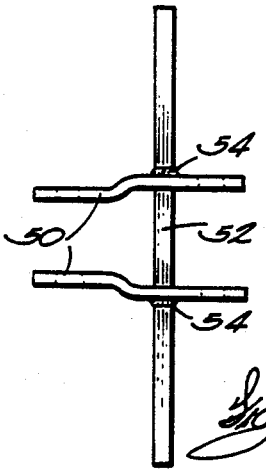
FIG. 6 is a bottom view of a portion of the chain shown in FIG. 5.
Figure 7:
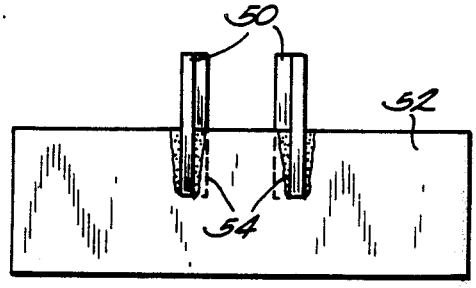
FIG. 7 is an end view of the portion of chain shown in FIG. 6.

Referring now to FIGS. 5–7, another preferred embodiment of the invention can be seen adapted for use on a machine such as an asphalt conveyor. Pairs of offset sidebars 50 and 51 are shown including pairs of extended height sidebars 50 joined by connecting offset sidebars 51. Alternate pairs of sidebars of the chain are extended height sidebars 50 which each have pusher plates or scraper plates 52 attached to them. In FIGS. 5–7, welds 54 are shown to hold the pusher or scraper plates to the extended height sidebar pairs. Each pair of sidebars is linked to the next pair of sidebars in the chain by a chain pin 16 in the manner previously outlined.

As will be apparent to those of ordinary skill in the art, the extended height sidebars of the invention provide a tool receiving area to which various tools could Possibly be attached.

While a preferred embodiment has been disclosed by way of example, it should be understood that certain modifications will be apparent to those skilled in the art. Thus, the scope of the invention should be limited only by the scope and spirit of the appended claims

I claim:

1. An offset sidebar chain comprising:

pairs of offset sidebars having heights perpendicular to the direction of chain travel when said chain is in use, at least one pair of offset sidebars of the chain having an extended height and each of the sidebars including a first portion having opposite ends, each of said pairs of sidebars having a forward end adapted to be connected by a chain pin to a preceding pair of sidebars and a rearward end adapted to be connected by another chain pin to a trailing pair of sidebars, and said pair of extended height sidebars each including an extended height portion having structure for supporting a tool, each sidebar of said pair of extended height sidebars including a continuous offset bend extending through the first portion thereof and continuing through the extended height portion thereof, such that both the first portion and the extended height portion include a continuous offset bend, a tool fastened to said extended height portion of said pair of extended height sidebars.

2. An offset sidebar chain as set forth in claim 1 wherein alternate pairs of offset sidebars of the chain comprise pairs of extended height sidebars.

3. An offset sidebar chain as set forth in claim 1 wherein said offset bend is defined by two continuous bend lines extending through the first portion thereof and continuing through the extended height portion thereof such that the forward end of each sidebar is parallel to and offset from its rearward end.

4. An offset sidebar chain as set forth in claim 3 wherein the sidebars of said pair of extended height sidebars are formed by cold stamping steel plates.

5. An offset sidebar chain as set forth in claim 1 wherein said tool comprises a cutter having a leading portion and a trailing portion, said leading portion including a cutting edge, wherein said leading portion of said cutter is fastened to both sidebars of said pair of extended height sidebars, and said trailing portion of said cutter is fastened to one sidebar of said pair of extended height sidebars.

6. An offset sidebar chain as set forth in claim 4 wherein the rearward end of each sidebar of said pair of extended height sidebars includes a bore therethrough for receiving a bushing, said bushing surrounding a portion of at least one of said chain pins, said bushing having opposite ends, one end housed in the bore in the rearward end of one of the sidebars and another end housed in the bore in the rearward end of the other of the sidebars, and a roller surrounding a portion of said bushing.

7. An offset sidebar chain as set forth in claim 5 wherein a spacer is included between said rearward end of said second portion of said one sidebar and said trailing portion of said cutter, said spacer having a thickness substantially the same as the distance the forward end of the extended height portion of the side bar is offset from the rearward end of said extended height sidebars.

8. An offset sidebar chain for use in a trenching machine, said chain comprising:

pairs of offset sidebars having heights perpendicular to the direction of chain travel, when said chain is in use, at least one pair of offset sidebars of the chain having an extended height and each of the sidebars including a first portion having opposite ends, each of said pairs of sidebars having a forward end adapted to be connected by a chain pin to a preceding pair of sidebars and a rearward end adapted to be connected by another chain pin to a trailing pair of sidebars, and each of said pair of extended height sidebars including an extended height portion having structure for supporting a cutter, each sidebar of said pair of extended height sidebars including a continuous offset bend line extending through the first portion thereof and continuing through the extended height portion thereof, such that both the first portion and the extended height portion include an offset bend, a cutter fastened to said extended height portion of said pair of extended height sidebars.

9. An offset sidebar chain as set forth in claim 8 wherein alternate pairs of offset sidebars of the chain comprise pairs of extended height sidebars.

10. An offset sidebar chain as set forth in claim 8 wherein said extended length sidebars each include two continuous bend lines extending from the first portion thereof and continuing through the extended height portion thereof such that the forward end of each sidebar is parallel and offset from its rearward end.

11. An offset sidebar chain as set forth in claim 10 wherein the sidebars of said extended height sidebars are formed by cold stamping steel plates.

12. An offset sidebar chain as set forth in claim 11 wherein said cutter has a leading portion and a trailing portion, said leading portion including a cutting edge, wherein said leading portion of said cutter is fastened to both sidebars of said pair of extended height sidebars, and said trailing portion of said cutter is fastened to one sidebar of said pair of extended height sidebars.

13. An offset sidebar chain as set forth in claim 12 wherein a spacer is included between said rearward end of said extended height portion of said one sidebar and said trailing portion of said cutter to make up for the distance the forward end is offset from the rearward end of said extended height sidebars.

14. An offset sidebar chain as set forth in claim 13 wherein said cutter is fastened to alternate sides of said chain at alternate links of said chain.

15. An offset sidebar chain as set forth in claim 14 wherein the rearward end of each sidebar of said pair of extended height sidebars includes a bore therethrough for receiving a bushing, said bushing surrounding a portion of at least one of said chain pins, said bushing having opposite ends, one end housed in the bore in the rearward end of one of the sidebars and another end housed in the bore in the rearward end of the other of the sidebars and a roller surrounding a portion of said bushing.

16. An offset sidebar chain for use in a conveyor, said chain comprising:

pairs of offset sidebars having heights perpendicular to the direction of chain travel, when said chain is in use, at least one pair of offset sidebars of the chain having an extended height and each including a first portion having opposite ends, a forward end adapted to be connected by a chain pin to a preceding pair of sidebars and a rearward end adapted to be connected by another chain pin to a trailing pair of sidebars, and said Pair of extended height sidebars including an extended height portion having structure for supporting a conveying member, each sidebar of said pair of extended height sidebars including a continuous offset bend extending through the first portion thereof and continuing through the extended height portion thereof, a conveying member fastened to said extended height portion of said pair of extended height sidebars, the conveying member being supported by the extended height portions of the pair of extended height sidebars and including a material pushing surface transverse to the direction of travel of the chain.

17. An offset sidebar chain as set forth in claim 16 wherein alternate pairs of offset sidebars comprise said pair of extended height sidebars.

18. An offset sidebar chain as set forth in claim 16 wherein said offset bend is defined by two continuous bend lines extending through the first portion thereof and continuing through the extended height portion thereof such that the forward end of each sidebar is parallel to and offset from its rearward end.

19. An offset sidebar chain as set forth in claim 18 wherein the sidebars of said pair of extended height sidebars are formed by cold stamping steel plates.

20. An offset sidebar chain as set forth in claim 16 wherein said plate is welded to each sidebar of said pair of extended height sidebars.

21. An offset sidebar chain as set forth in claim 20 wherein the rearward end of each sidebar of said pair of extended height sidebars includes a bore therethrough for receiving a bushing, said bushing surrounding a portion of at least one of said chain pins, said bushing having opposite ends, one end housed in the bore in the rearward end of one of the sidebars and another end housed in the bore in the rearward end of the other of the sidebars and a roller surrounding a portion of said bushing.

* * * * *